US005171018A

United States Patent [19]

Zhang

[11] Patent Number: 5,171,018

[45] Date of Patent: Dec. 15, 1992

[54] MATH-CHESS AND THE METHOD OF PLAYING IT

[76] Inventor: Maosen Zhang, Huangkou Middle School, Xiao, Anhui Province 235211, China

[21] Appl. No.: 821,199

[22] Filed: Jan. 15, 1992

[30] Foreign Application Priority Data

Jan. 26, 1991 [CN] China ..... 91100422.X
Jun. 15, 1991 [CN] China ..... 91216016.0

[51] Int. Cl.[5] ..... A63F 3/02
[52] U.S. Cl. ..... 273/260; 273/272
[58] Field of Search ..... 273/272, 260, 262, 255, 273/288, 299; 434/209, 191

[56] References Cited

U.S. PATENT DOCUMENTS

| | | | |
|---|---|---|---|
| 574,192 | 12/1896 | Climenson | 273/260 |
| 3,844,568 | 10/1974 | Armstrong | 273/272 |
| 3,904,207 | 9/1975 | Gold | 273/272 |
| 4,940,240 | 7/1990 | Braley | 273/272 |

FOREIGN PATENT DOCUMENTS

| | | | |
|---|---|---|---|
| 1054790 | 5/1979 | Canada | 273/272 |
| 2121692 | 1/1984 | United Kingdom | 273/272 |

*Primary Examiner*—Benjamin H. Layno
*Attorney, Agent, or Firm*—Roylance, Abrams, Berdo & Goodman

[57] ABSTRACT

The present invention relates to a math-chess and the method of playing it. The math-chess comprises one checkerboard and 32 pieces. The checkerboard is like that used in the ordinary chess. The pieces are in two colors, sixteen pieces each, they are 0, 1, 2, 3, 4, 5, 6, 7, 8, 9, +, −, *, ÷, X and Y. X and Y can be used to represent any number. The said math-chess is for two players. A game of the math-chess has four stages: disposing, disclosing, moving and concluding. The position is made secretly. The rules of playing are like those used in Chinese checkers. The aim of moving is to form an algebraic expression with the pieces of one's own side so that it can constitute an equation with the opponent's pieces and take them.

10 Claims, 5 Drawing Sheets

MATH-CHESS AND THE METHOD OF PLAYING IT

BACKGROUND OF THE INVENTION

The present invention relates to a board game and the method of playing it. More particularly the invention relates to such a game and its playing method wherein both of the ability of algebraic operation and the playing skill of Chinese checkers are required.

The ordinary chess includes a square chessboard consisting of 64 squares in black or white alternating with each other and includes 32 chessmen which are in two different colors. It is used by two players, each having 16 pieces of the same color, which are different in color from those of his opponent. The 16 pieces of each side include king, queen, bishop, knight, rook and pawn. The rules governing chess playing are well known to us all. Chess as a most popular game of the world is full of skill and interest and is most beneficial to the promotion of the thinking ability of children, but it is not easy to learn how to play it.

Chinese chekers is also a popular game and is very easy to play. It is also a game that is helpful to the cultivation of children's power of observation. The shortcoming of it is that the method of playing it is too simple and monotonous.

Neither chess nor Chinese checkers can do anything to give players direct training of their ability of algebraic operation.

SUMMARY OF THE INVENTION

It is an object of this invention to provide a new kind of board game—math-chess and the method of playing it. The math-chess of the present invention is for two players and it is remarkably full of skill and interest. It is good for training the player's power of observation and thinking, especially their ability of algebraic operation.

The math-chess of the invention comprises:

a square checkerboard having sixty-four little squares arranged in eight rows and eight columns thereon;

thirty-two pieces in two different colors, sixteen pieces each, said pieces of either color including respectively ten pieces of numeral: 0, 1, 2, 3, 4, 5, 6, 7, 8, 9, four pieces of mathematical symbol: +, −, *, ÷, and two pieces of unknown number.

The method for playing the math-chess of the present invention comprises the following steps:

(a) each player secretly disposing his own sixteen pieces in the squares of the two rows at the near end of the checherboard;

(b) each player disclosing his own position to the other;

(c) each player moving in turn to form an algebraic expression with his own pieces including at least one piece of mathematical symbol without any empty square between any two pieces of the expression which constitutes an equation with the opponent's piece or pieces to take the opponent's piece or pieces concerned;

(d) crying out what number the piece of unknown number representing in case a piece of unknown number being used in said expression;

(e) restricting movement of one piece to any one of the eight squares neighbouring its own square or to other square by leaps without a limit to the number of squares over which it leaps on condition that these squares are occupied by pieces and that these squares are all in the same row or column with its own square or in the diagonal along the extension line of one of the two diagonals of its own square;

(f) repeating steps (c), (d) and (e) until all pieces of one player are taken or no piece is taken during a fixed number of turns.

In the above mentioned method a piece is allowed to move by continous leaps and the players are allowed to exchange the positions of any two pieces of mathematical symbol of his own side as a move.

Related objects and advantages of the present invention will be apparent from the following description.

DETAILED DESCRIPTION OF THE INVENTION

The math-chess of the present invention is composed of a square checkerboard and thirty-two pieces. Its checkerboard similar to that used in the ordinary chess is a square one having sixty-four squares arranged in eight rows and eight columns thereon. These sixty-four squares are preferably in two different colors alternating with each other. The thirty-two pieces are also in different colors, each of the players holding sixteen pieces of the same color. The sixteen pieces include ten pieces of arabic numeral: 0, 1, 2, 3, 4, 5, 6, 7, 8, 9, four pieces of mathematical symbol: +, −, *, ÷, and two pieces of unknown X, Y (or U, V, etc.).

The main point of the present invention is to make use of pieces of one's own side to form an algebraic expression so that an equation can be constituted with the piece (or pieces) of the opponent in the same straight line and to take it (or them).

The math-chess of this invention is played by two person, When the two players are playing, they have to pass four stages, namely, disposing, disclosing, moving and concluding stages.

In disposing, the players are to place their sixteen pieces in the squares of the last two rows at the ends of their own sides, just as they in playing the ordinary chess, except for the fact that the positions of these pieces are not fixed and can be changed at the players' will. In order to keep it a secret from the opponent, the player can make his position with the backs of the pieces upward or towards the opponent. He can also use a sheltering board when disposing so that he can make his position with the fronts of the pieces upward. The time limit for disposing can be fixed, say, five minutes.

After disposing comes the stage of disclosing, at which the players are required to disclose their positions to their opponents by turning over their pieces or placing them flat on the checkerboard or by removing the sheltering board. Once disclosed, no pieces are allowed to change positions any more.

Next comes the stage of moving. The rules governing the moving of pieces are like those used in Chinese checkers. The players move their pieces in turn, moving a piece at a time. A piece is allowed to move in any one of the eight directions to the neighbouring square. If the neighbouring square is occupied, it is allowed to leap over the occupied square or even over several occupied squares at a time only if there is no empty square between any two of them and if these occupied squares are in the same row or column with its own square or these occupied checks are all in the direction along the extension line of one of the diagonals of its own square just in the same way as in playing Chinese checkers. It is also allowed to make continuous leaps, that is, to go on leaping in accordance with the aforesaid rules after the first leap, and all this is considered to be a single move.

Compared with the rules for playing Chinese checkers, those of the invented math-chess have one more extra rule for changing the positions of the pieces of mathematical symbol. According to this rule, any two pieces of mathematical symbol may have their positions exchanged at a move, which is somewhat like the exchange of positions between a rook and the king in the ordinary chess.

Each piece of numeral may be independently considered to be a number of one figure and several pieces of numeral of the same color in one straight line, when linked together, may be collectively considered to be a multi-figure number.

When the pieces of one's own side are linked in the same straight line with a piece or pieces of mathematical symbol to form an algebraic expression which can constitute an equation with the opponent's piece (or pieces) in the same straight line, the opponent's piece (or pieces) concerned will be taken. No empty square is allowed to intervene in the said algebraic expression. The pieces of both sides form the two sides of the equation respectively with the equality sign "=" omitted. Whether there is empty square between the pieces of both sides or not, or how many empty squares are between them is not a thing to be considered.

When the player is moving a piece to form an algebraic expression including at least one of the pieces of unknown number X and Y with a view to taking the opponent's pieces, he must cry out what number X or Y is meant at the time when placing the piece on the checkerboard. If he fails to do so or cries out a wrong number, he can not take the opponent's pieces until in the next turn he uses the method of exchanging the positions of pieces of mathematical symbol and cries out the right number that X or Y represents.

If the math-chess is played in accordance with the aforesaid rules and the pieces of one's side are all taken, the player of this side is said to have lost the game. If it arise the case that there was no piece being taken during a fixed number of turns, say, 10 turns, and there are still some pieces remaining on either side, the game is also considered to conclude and the player who has more pieces left will be the winner. If the remaining pieces of both sides are equal, the game ends in a draw.

DESCRIPTION OF THE PREFERRED EMBODIMENTS

Figure 1:
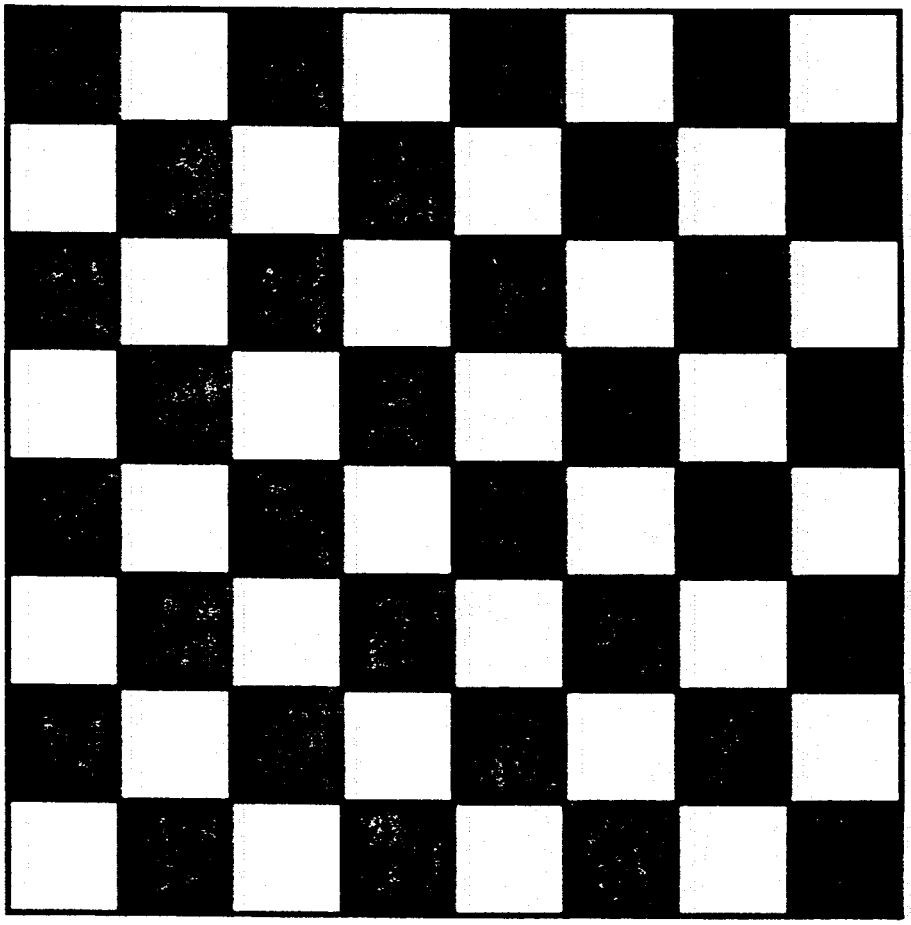
FIG. 1 illustrates a checkerboard of the math-chess of the present invention.

FIG. 1 shows the checkerboard used in the math-chess of the persent invention. Like the chessboard used in the ordinary chess, it is a square divided into 64 little squares of black or white alternating with each other.

Figure 4:
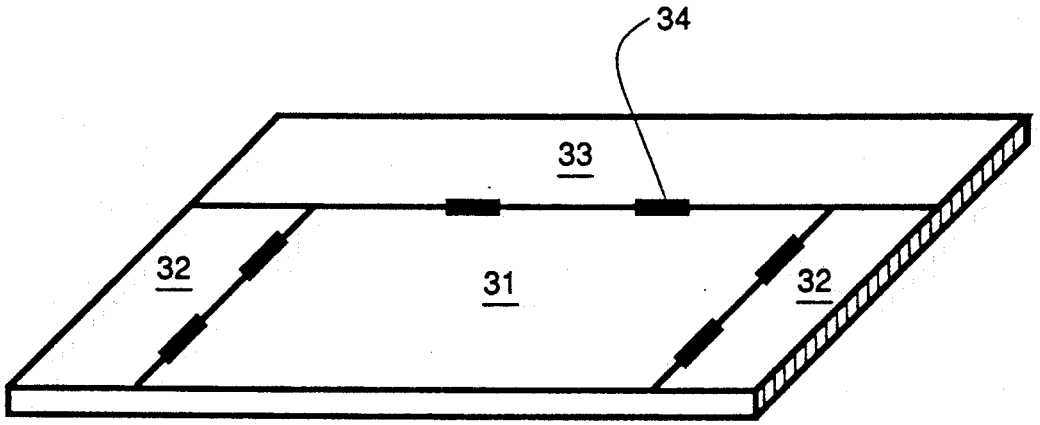
FIG. 4 illustrates the sheltering board of FIG. 3 in expended state when it is not in use.

The pieces of the math-chess are thirty-two in number, sixteen in black and sixteen in white, each composed of ten pieces of Arabic numeral: 0, 1, 2, 3, 4, 5, 6, 7, 8, 9, four pieces of mathematical symbol: +, −, *, ÷, and two pieces of unknown number X, Y (see FIG. 4).

Figure 2:
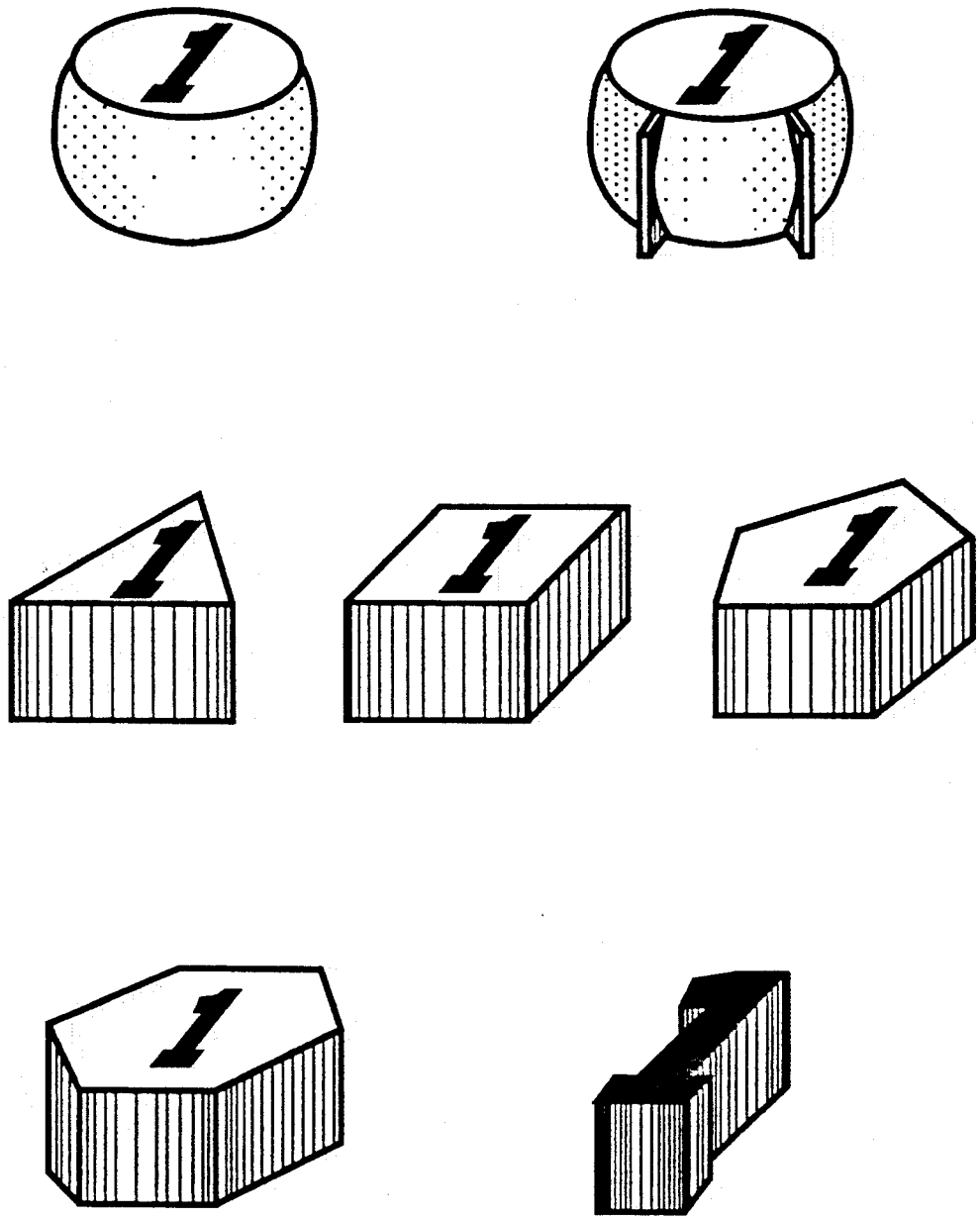
FIG. 2 shows various shapes of pieces of the math chess to be chosen.

FIG. 2 shows a few shapes of the pieces of the math-chess for choice. The shape generally adopted is that of a drum, sometimes that of a drum with props. It may also be that of a prism (for example, a triangular prism or a quadrangular prism or a pentagonal prism or a hexagonal prism), the advantage of these last-mentioned shapes being that they can make the pieces placed upright when they are laid out, so that it is easier for the player to dispose his pieces.

Figure 3:
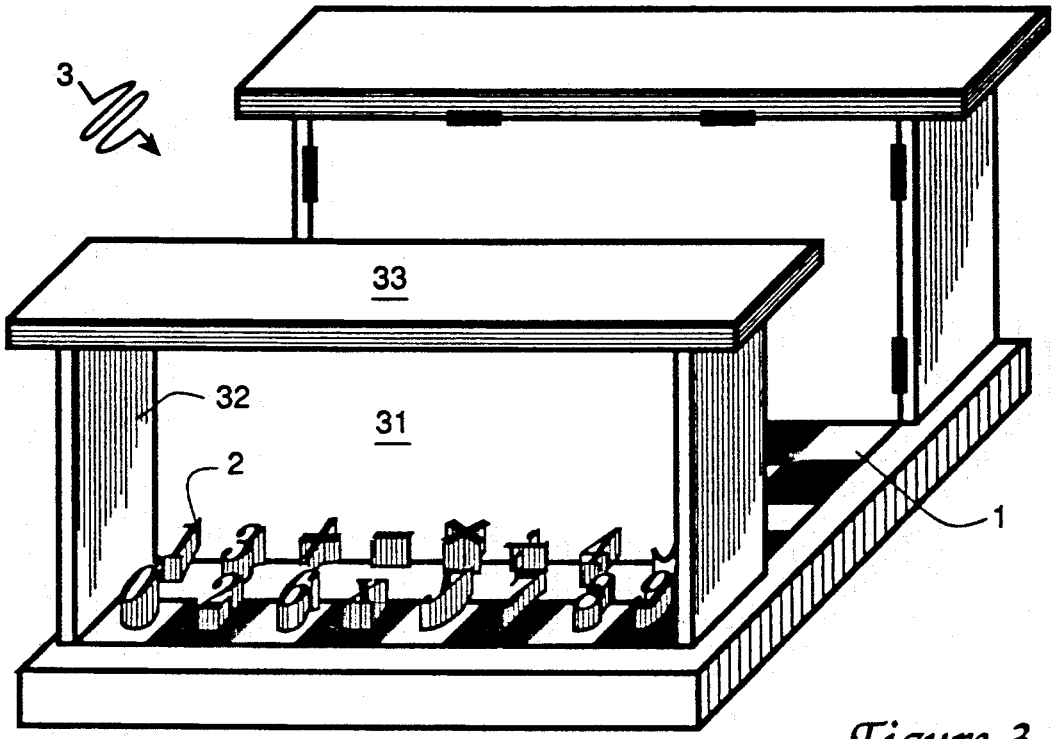
FIG. 3 shows a preferred embodiment of the invention, in which a sheltering board is used.

FIG. 3 shows a preferred embodiment of the math-chess, with 1 denoting the checkerboard, 2 the pieces and 3 the sheltering board. The sheltering board 3 is composed of a main board 31, two side boards 32 and a top board 33. The side boards 32 and the top board 33 are respectively linked with the main board 31 by means of hinges 34. When expanded, the sheltering board 3 becomes a flat board like that shown in FIG. 4 and is easy to be put away. By means of the sheltering board, the player is enabled to place his pieces with their fronts upward when he is positioning and he has only to remove the sheltering board when the position is disclosed, thus freeing him from the inconvenient action of turning over each piece or placing it flat on the checkerboard. The shape of the sheltering board is also varied.

Figure 5:
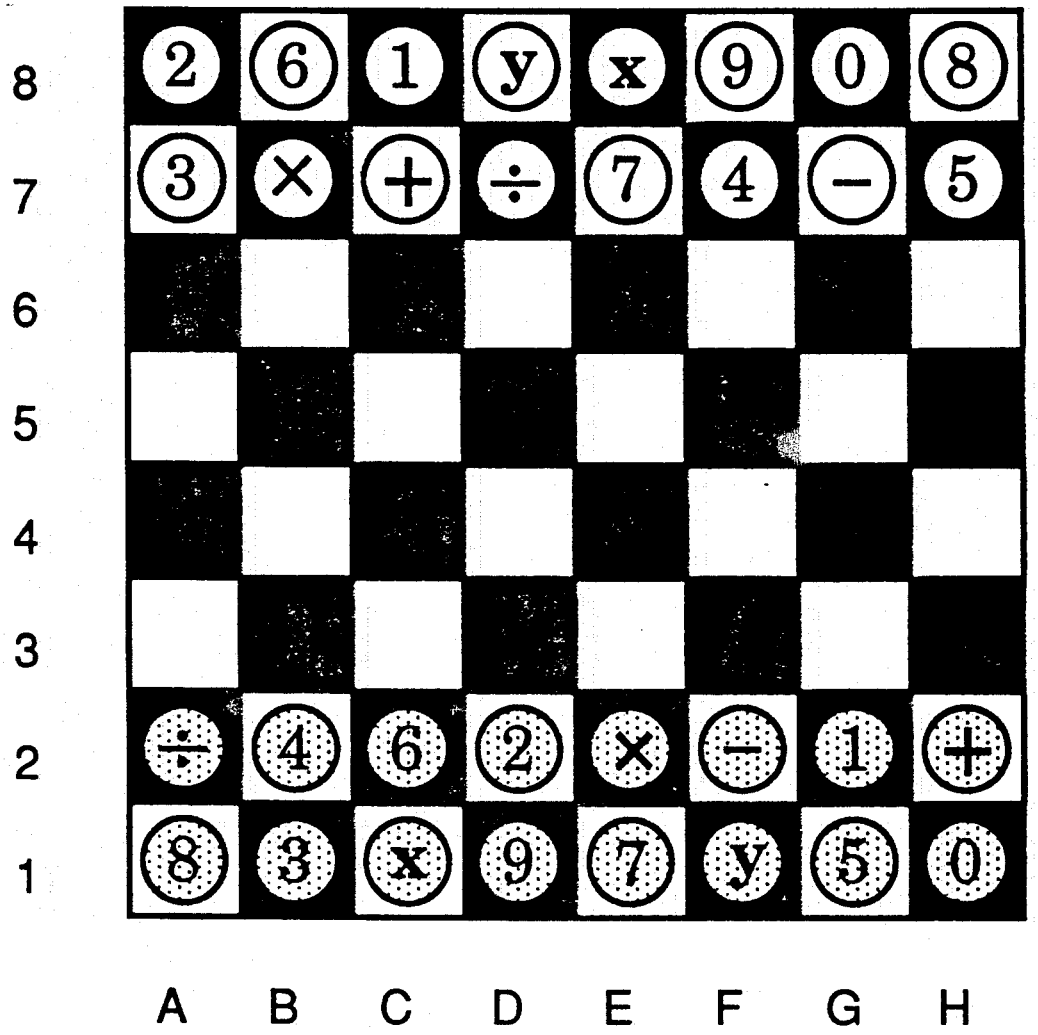
FIG. 5 shows a game of the math-chess at the disclosing stage.

FIG. 5 shows a game of the math-chess at its disclosing stage. The numbers and letters outside the checkerboard are added for the convenience of giving explanations.

As shown in FIG. 5, if the player of the white side is to move first (For each game the white side may be supposed to move first, or it may be through making a guess to determine which side is to move first), he may have the following ways of moving:

1. Moving the piece of unknown number X from E8 to C6 to form an algebraic expression "1+X" with his own pieces "1" in C8 and "+" in C7 and at the same time to form an algebraic expression "2+X" with his own pieces "2" in A8 and "*" in B7 and crying out simultaneously "X=5" when the piece X is placed on the checkerboard, he then can take the opponent's "6" in C2 and also the opponent's "1" in G2 and "0" in H1 (the last two pieces form the 2-figure number of 10). This way of moving is called "kill two birds with one stone".

2. Moving Y from D8 to B6 to form an expression "6*Y" with his own pieces and crying out "Y=43/6" when Y is placed on the checkerboard, he then can take the opponent's "4" in B2 and "3" in B1 in the same line (The last two pieces form the 2-figure number of 43).

3. Moving "4" from F7 to F6 to form "8−4" with his own pieces, he can then take the opponent's "4" in B2.

4. Moving "9" from F8 to D6 to form an algebraic expression "Y÷9" with other pieces of his own side and crying "Y=261" when Y is placed on the checherboard, he can then take the opponent's "2" in D2 and "9" in D1 (The opponent's two pieces form the number 29).

5. Moving X from E8 to G6 to form an algebraic expression "0−X" with other pieces of his own side and crying out "X=−15" when X is placed on the checkerboard, he can then take the opponent's "1" in G2 and "5" in G1 (The opponent's two pieces form the number 15), etc.

Figure 6:
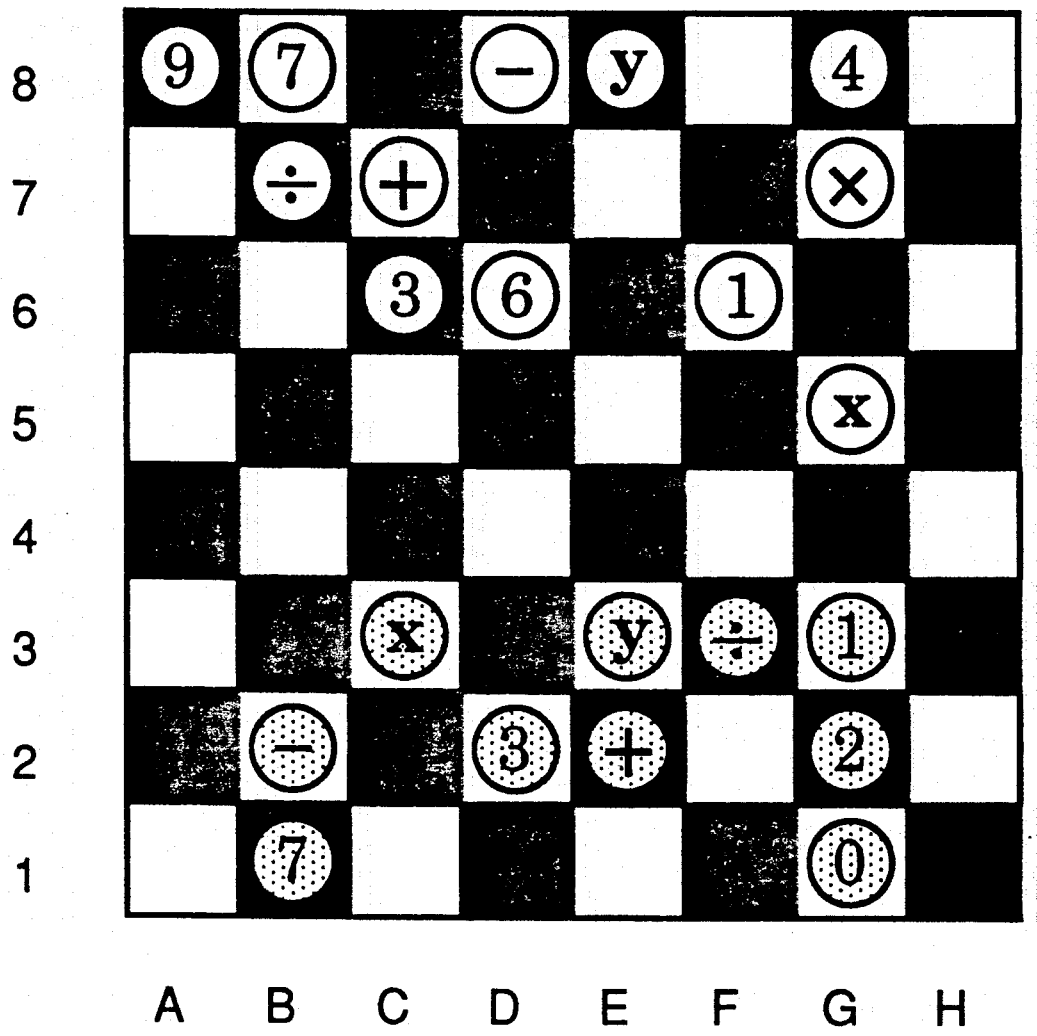
FIG. 6 shows a game of the math-chess at the moving stage.

FIG. 6 shows a game of the math-chess at the stage of moving. If it is now for the player of the white side to move, he can choose any one of the following ways of moving:

1. Exchanging the positions of "+" in C7 and "−" in D8 to form an expression "7−6" with the pieces "7" in B8 and "6" in D6 of his own side (In accordance with the rule of exchanging positions of pieces of mathematical symbol), he then can take the opponent's "1" in G3.

2. Moving X from G5 to G6 to form an algebraic expression "4*X" with other pieces of his own side and crying out "X=30" when X is placed on the checkerboard, he then can take the opponent's pieces "1" in G3, "2" in G2 and "0" in G1 (The opponent's three pieces form the number 120).

3. Continuously moving X from G5 to E7, C5, C8, F8 and finally to H8 to form an expression of "X*1" with other pieces of his own side, he can then take the opponent's X in G3, etc.

If it is now for the player of the black side to move, he can choose any one of the following ways of moving:

1. Moving X from C3 to E1 to form an algebraic expression "X+Y" with his own pieces "+" and "Y" and crying out "X=0" when X is placed on the checkerboard, he can then take the opponent's Y in E8.

2. Moving Y from E3 to E4 to an the algebraic expression "2÷Y" with his own pieces "÷" and "Y" and crying out "Y=6" when Y is placed on the checkerboard, he can then take the opponent's pieces "3" in C6, "÷" in B7 and "9" in A8 (The three pieces are in the same straight line with the expression and they form the algebraic expression "3÷9".).

As the checkerboard used in the invention may be just the same as that used in the ordinary chess and the number of pieces of the invention is equal to that of the ordinary chess, it can be used as the ordinary chess if the backs of its pieces are printed with the symbols of the chessmen of the ordinary chess, by this way, a set of chess can be used as two.

While the invention has been described in conjunction with the specific embodiments thereof, it is evident that many alternatives, modifications and variations will be apparent to one skilled in the art in light of the foregoing description. For example, the game is readily adaptable to a software/computer format. Accordingly it is intended to embrace all such alternatives, modifications and variations as fall within the spirit and broad scope of the invention.

What is claimed is:

1. A math-chess for two players, comprising:

a square checkerboard having sixty-four squares arranged in eight rows and eight columns thereon;

thirty-two pieces divided into two distinguishable sets, each set having a color distinguishable from the color of the other set, each set having sixteen pieces said pieces of either color including respectively ten pieces of numeral: 0, 1, 2, 3, 4, 5, 6, 7, 8, 9, four pieces of mathematical symbol: +, −, *, ÷, and two pieces of unknown number.

2. The math-chess of claim 1 wherein said sixty-four squares on the checkerboard are in two different colors alternating with each other.

3. The math-chess of claim 1 wherein the two pieces of unknown number in each color are the pieces X and Y.

4. The math-chess of claim 1 further including two sheltering boards for disposing.

5. The math-chess of claim 1 wherein each said piece has a symbol of the chessman of the ordinary chess on its back.

6. A method for playing a math-chess which is composed of a square checkerboard having sixty-four squares arranged in eight rows and eight columns thereon and thirty-two pieces divided into two distinguishable sets, each set having a color distinguishable from the color of the other set, each set having sixteen pieces including ten pieces of numeral, four pieces of mathematical symbol and two pieces of unknown number comprising:

(a) each player secretly disposing his own sixteen pieces in the squares of the two rows at the near end of the checherboard;

(b) each player disclosing his own position to the other;

(c) each player moving in turn to form an algebraic expression with his own pieces including at least one piece of mathematical symbol without any empty square between any two pieces of the expression which constitutes an equation with any of the opponent's piece or pieces on the checkerboard;

(d) removing the opponent's piece or pieces on the checkerboard which constitutes the equation;

(e) crying out what number the piece of unknown number representing in case a piece of unknown number is used in said expression;

(f) restricting movement of one piece to any one of the eight squares neighbouring its own square or to other square by leaps without a limit to the number of squares over which it leaps on condition that these neighboring squares are occupied by pieces and that these squares are all in the same row or column with its own square or in the diagonal along the extension line of one of the two diagonals of its own square;

(g) repeating steps (c), (d), (e) and (f) until all pieces of one player are taken or no piece is taken during a fixed number of turns.

7. The method of claim 6 wherein as part of step (e) a piece is allowed to move by continous leaps.

8. The method of claim 6 wherein the players are allowed to exchange the positions of any two pieces of mathematical symbol of his own side as a move.

9. The method of claim 6 wherein a piece of numeral is independently considered to be a number of one figure.

10. The method of claim 6 wherein several pieces of numeral of the same color positioned in one line are collectively considered to be a multi-figure number.

* * * * *